United States Patent [19]

Smith et al.

[11] 4,362,589

[45] Dec. 7, 1982

[54] METHOD OF MANUFACTURE OF TAPERED WOOD I-BEAM

[75] Inventors: Joe Smith, Boise; Stanley J. Willmorth, Eagle, both of Id.

[73] Assignee: Trus Joist Corporation, Boise, Id.

[21] Appl. No.: 325,132

[22] Filed: Nov. 27, 1981

[51] Int. Cl.[3] ..... B32B 31/00; E04B 7/02; E04B 1/32

[52] U.S. Cl. ..... 156/254; 156/266; 156/304.1; 144/350; 52/90; 52/639

[58] Field of Search ..... 156/152, 211, 254, 266, 156/304.1; 144/316, 319; 52/90, 639, 574, 729; 428/541

[56] References Cited

U.S. PATENT DOCUMENTS

| | | | |
|---|---|---|---|
| 899,033 | 9/1908 | Dodds | 29/155 |
| 1,344,229 | 6/1920 | Hutchinson | 52/729 X |
| 1,377,891 | 5/1921 | Knight | 52/730 |
| 1,506,509 | 8/1924 | Sutherland | 156/304.1 |
| 1,594,658 | 8/1926 | Bushong | 29/155 |
| 1,843,318 | 2/1932 | Frease | 52/720 |
| 2,376,906 | 5/1945 | Davidson | 52/639 |
| 2,382,201 | 8/1945 | Burke et al. | 52/729 |
| 2,886,857 | 5/1959 | Brosenius | 52/639 |
| 3,333,389 | 8/1967 | Lichti | 52/639 |
| 3,365,852 | 1/1968 | Pitillo | 52/639 |
| 3,477,485 | 11/1969 | Talbott | 29/155 |
| 3,490,188 | 1/1970 | Troutner | 52/690 |
| 3,557,422 | 1/1971 | Pfaff, Jr. | 52/298 |
| 3,616,091 | 10/1971 | Troutner | 156/258 |
| 3,733,231 | 5/1973 | Rutkouski et al. | 52/639 |
| 3,800,485 | 4/1974 | Yates | 52/90 |
| 3,883,999 | 5/1975 | Nicoll, Jr. | 52/90 |
| 3,894,908 | 7/1975 | Troutner et al. | 156/258 |
| 3,991,535 | 11/1976 | Keller et al. | 52/642 |

FOREIGN PATENT DOCUMENTS

| | | | |
|---|---|---|---|
| 49303 | 9/1931 | Norway | 144/316 |
| 759682 | 9/1980 | U.S.S.R. | 52/639 |

*Primary Examiner*—Edward C. Kimlin
*Assistant Examiner*—Louis Falasco
*Attorney, Agent, or Firm*—Klarquist, Sparkman, Campbell, Leigh, Whinston & Dellett

[57] ABSTRACT

A method of manufacture of a tapered wood beam, such as an I-beam, is described. With such method an I-beam of uniform width including a web member of uniform width and a pair of first flange members attached to the opposite sides thereof, is first produced and then cut into two portions by sawing the web member of such beam along a diagonal line to form two tapered web members each attached at one side to a first flange member. The resulting I-beam portions are then assembled by releasably fastening, such as clamping, the first flange members together in back to back relationship so that the sawn edges of the tapered web members are facing outwardly and parallel to form an assembly of substantially uniform width. This assembly is then fed through an automatic I-beam manufacturing machine, which may be the same machine in which the uniform width I-beam was produced, to fasten a pair of second flange members to the sawn edges of such tapered web members resulting in the production of two interconnected I-beams of tapered width. The two tapered I-beams are separated by unclamping the first flange members from each other.

20 Claims, 5 Drawing Figures

FIG. 1A
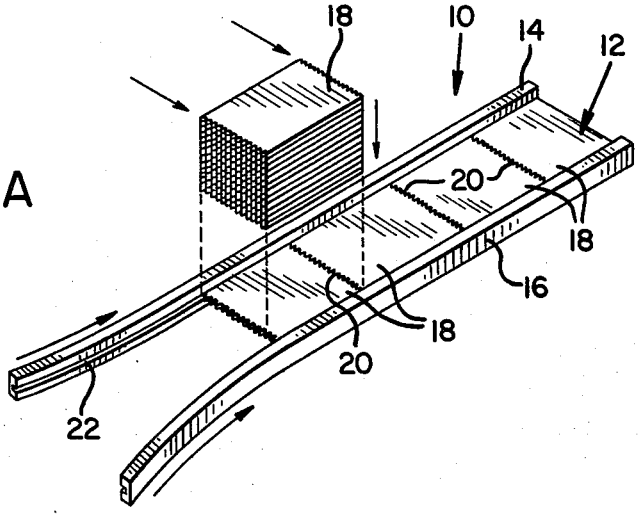
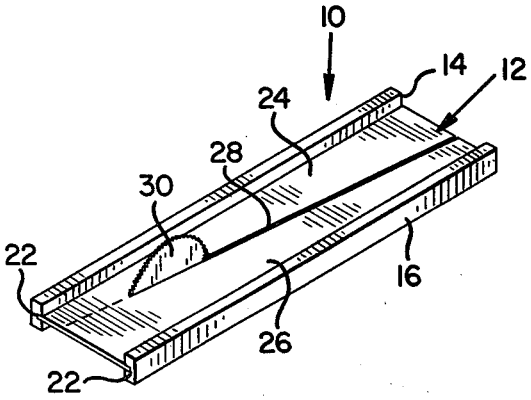
FIG. 1B
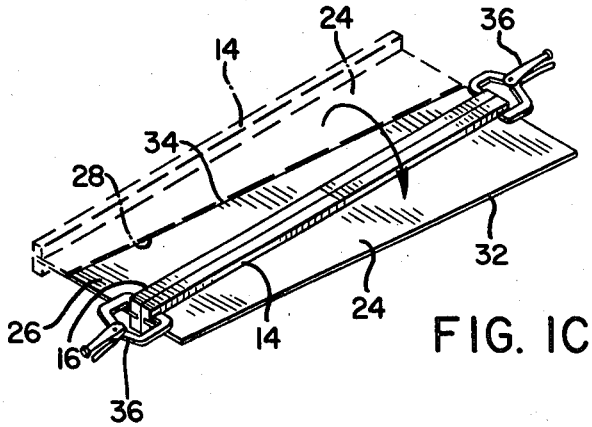
FIG. 1C
FIG. 1D
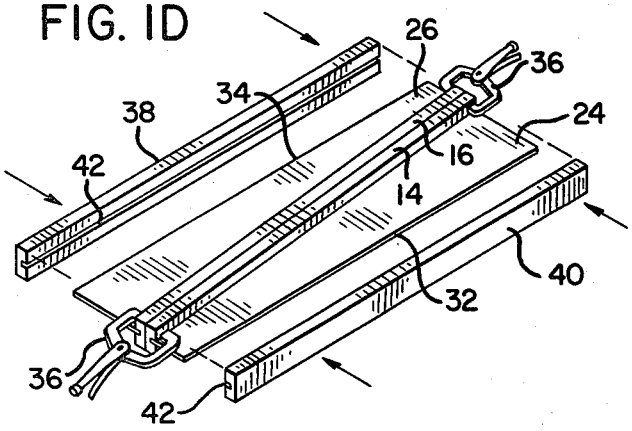
FIG. 1E
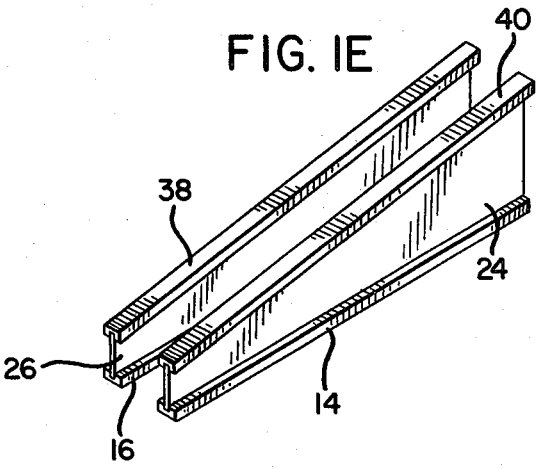

METHOD OF MANUFACTURE OF TAPERED WOOD I-BEAM

BACKGROUND OF INVENTION

The subject matter of the present invention relates generally to tapered wooden structural members or beams, and in particular, to tapered wood I-beams and their method of manufacture. Such wood I-beams are especially useful in making trusses or joists for the floor or ceiling of a building or for other structures.

Previously wood I-beams have been made of a uniform width by automatic manufacturing machines of the type disclosed in U.S. Pat. No. 3,894,908 of Troutner et al, issued July 15, 1975 and U.S. Pat. No. 3,616,091 of Troutner, issued Oct. 26, 1971. In addition, it has been previously proposed to form a wood roof truss with tapered I-beam sections as shown in U.S. Pat. No. 3,991,535 of Keller et al, issued Nov. 16, 1976 and U.S. Pat. No. 3,490,188 of Troutner, issued Jan. 20, 1970. However, such roof trusses have had spaces between adjacent I-beam sections and the tapered I-beam sections have been made manually for the most part, not produced by automatic manufacturing machines.

The method of manufacture of the present invention enables tapered wood beams, such as I-beams, to be produced substantially entirely by automatic manufacturing machines, thereby greatly reducing their cost of manufacture. The present method includes first producing an I-beam of uniform width, next cutting the I-beam into two portions by sawing the web member of such beam along a diagonal line to form two tapered width web members, and then fastening additional flange members to the sawn edges of such tapered web members. In addition, by using the method of manufacture of the present invention the same automatic manufacturing machines which produce wood I-beams of uniform width can also be employed to manufacture wood I-beams of tapered width. This is accomplished by releasably clamping or otherwise fastening the cut portions of the uniform width I-beam together in back to back relationship at the first flange members of such portions to form an assembly of tapered web members and flange members which is of uniform width so it can be transmitted through such machine. The machine glues second flange members to the cut edges of the tapered web members to produce two tapered I-beams which are then unclamped to separate such beams. As a result, the manufacturing costs of the tapered I-beams made by the method of manufacture of the present invention are further reduced.

It has been previously proposed to cut steel I-beams in two along a diagonal to provide two tapered T-shaped beam sections which are then reassembled to produce a tapered steel pole assembly as shown in U.S. Pat. No. 1,594,658 of Bushong, issued Aug. 3, 1926 or a structural metal member such as a purlin as shown in U.S. Pat. No. 899,033 of Dodds, issued Sept. 22, 1908. However, in neither of these patents are the tapered I-beam portions fastened together in back to back relationship at their flanges to position the cut edges of the web member outwardly and to attach a second pair of flanges to such cut edges of the web member in order to form two tapered I-beams in the manner of the present invention.

SUMMARY OF INVENTION

Therefore, it is one object of the present invention to provide an improved method of manufacture of tapered wood beams which is simple, efficient and inexpensive.

Another object of the invention is to provide such a method of manufacture of tapered wood I-beams in which an I-beam of uniform width is cut in two diagonally along the length of its web member to form a pair of tapered width web members having first flange members attached to one side thereof, such flange members then being releasably fastened back to back to form a web and flange assembly with the cut edges of the web members extending outwardly, a second pair of flange members being secured to the two cut edges of the tapered web members and thereafter the first pair of flange members are unfastened to separate the resulting pair of tapered I-beams.

A further object of the invention is to provide such a method of manufacture in which the tapered web member is formed by a plurality of laminated wood web portions joined together by glue joints at their ends so that such web member extends substantially the entire length of the flange members to provide an I-beam of great strength and of any desired length.

An additional object of the invention is to provide such a method of manufacture of a tapered I-beam in which the web and flange assembly is of substantially uniform width so that the same automatic manufacturing apparatus which forms the I-beam of uniform width can be employed to produce the tapered I-beams from such assembly.

Still another object of the invention is to provide such a method of manufacture in which the assembly of wedge and flange members is fastened together by releasably clamping the first flange members together so that the finished tapered I-beams can be quickly separated after manufacture by unclamping.

A still further object of the invention is to provide a method of manufacturing tapered I-beams in which a pair of such tapered I-beams is manufactured simultaneously by the same method steps and manufacturing apparatus to reduce the cost of manufacture.

DESCRIPTION OF DRAWINGS

Other objects and advantages of the present invention will be apparent from the following detailed description of a preferred embodiment thereof and from the attached drawings of which:

FIGS. 1A to 1E illustrate different steps in a method of manufacture of tapered I-beams in accordance with the present invention.

DESCRIPTION OF PREFERRED EMBODIMENT

The preferred embodiment of the method of manufacture of tapered wood I-beams in the manner of the present invention includes the method steps shown in FIGS. 1A to 1E. As shown in FIG. 1A, a wood I-beam 10 of uniform width including a web member 12 of uniform width and a first pair of flange members 14 and 16 attached to the opposite side edges of such web member, is made with the automatic manufacturing machine shown in U.S. Pat. No. 3,894,908 of Troutner et al. The web member 12 is formed of a plurality of web sections 18 which are joined together at their ends to form butt joints 20 between such web sections. The web sections 18 may be made of plywood or other laminated wood members and have their opposite ends serrated to form a plurality of inter-locking projections which are glued together in order to form the butt joints 20. In this manner, a web member 12 of any desired length can be produced, such web member extending substantially the entire length of the flange members 14 and 16.

The flange members 14 and 16 are provided with grooves 22 along the entire length of one side thereof by means of a router or other cutting device and the opposite side edges of the web member 12 are inserted into such grooves after glue is applied to the groove to bond the flange members to the web member in order to form the uniform width I-beam 10. The flange members 14 and 16 may each be made of a single piece of lumber such as 2×4's, or can be a laminated wood member made of layers of wood veneer. In addition, the web member 12 can be made of a single piece of wood or a laminated wood member such as plywood, or a particle board containing wood particles bonded together by a suitable resin bonding material. The opposite edges of the web member 12 are each compressed to provide a tapered edge which is inserted into groove 24 having a tapered cross-section in the manner shown in U.S. Pat. No. 3,490,188 of Troutner.

As shown in FIG. 1B in the second method step, the uniform width I-beam 10 of FIG. 1A is cut into two tapered web members 24 and 26 along a diagonal line 28 by any suitable cutting means, such as a circular saw 30. After cutting, each of the tapered web members 24 and 26 has one of the first pair of flange members 14 and 16 attached to its outer edge. Of course, the tapered web members 24 and 26 are also provided with cut edges 32 and 34, respectively, opposite from such outer edges. The tapered web members 24 and 26 are of the same trapezoidal shape tapering from a maximum width at one end to a minimum width at the opposite end of such tapered web member.

As shown in FIG. 1C in the third method step, the tapered web members 24 and 26 and their attached flange members 16 and 14, respectively, are assembled with such flange members in contact with a back to back relationship. Thus, after the sawing step of FIG. 1B, the tapered web member 24 is moved from the position shown in phantom lines to the assembly position shown in solid lines in FIG. 1C. In the assemble position the outer surfaces of the flanges 14 and 16 are in contact with each other and the cut edges 32 and 34 of tapered wedge members 24 and 26, respectively, extend outwardly from the assembly. The assembly of tapered web members and flange members is releasably fastened together in any suitable manner, such as by snap clamps 36 at the opposite ends thereof or by nuts and bolts extending through the flange members 14 and 16 at positions spaced uniformly along the length of such flange members.

The assembly of two tapered web members 24, 26 and two flange members 14 and 16 is then secured to a second pair of flange members 38 and 40 in the fourth method step of FIG. 1D. The second flange members 38 and 40 both have grooves 42 along the entire length of one side thereof for engagement with the cut edges 32 and 34 of the tapered web portions. The flange members 38 and 40 are identical in shape to the flange members 14 and 16 and are glued within the grooves 42 to the tapered web members 24 and 26 in a similar manner to that described above with respect to FIG. 1A. As a result, two releasably connected tapered I-beams are formed at the completion of the method step of FIG. 1D.

The assembly of FIG. 1C is fastened together with the small end of one tapered web member in alignment with the large end of one other tapered web member to provide such assembly with a substantially uniform width. This enables the second pair of flanges 38 and 40 to be fastened to the cut edges 32 and 34 of the tapered web members in the step of FIG. 1D by means of an automatic I-beam manufacturing machine of the ype shown in U.S. Pat. No. 3,894,908 which was also used to form the uniform width I-beam 10 of FIG. 1A. It should be noted that in the machine of the above cited patent there is a provision for making I-beams of different width by adjusting the position of a horizontal frame member in the manner shown in FIG. 2B of such patent whose disclosure is hereby incorporated by reference.

As shown by FIG. 1E in the fifth method step, the two tapered I-beams are separated from each other by unfastening the releasably secured flange members 14 and 16 to disassemble the assembly after the step of FIG. 1D. It may then be necessary to trim the opposite ends of the tapered I-beams to the proper length. However, in some cases this is not necessary. This disassembly is accomplished by releasing the clamps 36 to separate the two tapered I-beams. Of course, the width of the web member 12 in the uniform width I-beam 10 of FIG. 1A must be made equal to the sum of the maximum width at one end of the tapered web member 24 plus the minimum width of the other end of the tapered web member 26. However, it must be remembered in determining the proper width for web member 12 that the total width of the tapered I-beams also includes the thickness of the additional flange members 38 and 40 less the depth of the grooves 42 in such flange members.

It will be obvious to those having ordinary skill in the art that many changes may be made in the above-described preferred embodiment of the present invention. For example, other types of wooden beams can be produced such as box beams which may be formed by joining two tapered I-beams together. Therefore, the scope of the invention should be determined by the following claims.

We claim:

1. A method of manufacture of tapered wood beams, comprising the steps of:

forming a substantially I-shaped beam with a wood web member of substantially uniform width secured at its opposite sides to a first pair of flange members;

cutting said uniform width web member longitudinally into a pair of tapered width web members each with one of said first pair of flange members secured thereto;

fastening said first pair of flange members together to position the two cut edges of said pair of tapered web members outwardly of said first flange members and substantially parallel to each other to provide a web and flange assembly;

securing a second pair of flange members to the cut edges of said pair of tapered web members; and unfastening said first pair of flange members to disassemble the assembly and to provide a pair of tapered beams.

2. A method in accordance with claim 1 in which the uniform width beam and the tapered beams are all I-beams.

3. A method in accordance with claim 2 in which the web and flange assembly is of substantially uniform width with the maximum width end of one tapered web member being aligned with the minimum width end of the other tapered web member.

4. A method in accordance with claim 1 in which at least one of the web and flange members is made of laminated wood.

5. A method in accordance with claim 1 in which the tapered web member is formed by a plurality of web portions joined together at their ends so that said web member extends continuously along substantially the entire length of said flange members.

6. A method in accordance with claim 1 in which the first and second pairs of flange members are each provided with a longitudinal groove and the edges of the tapered web members are secured in said grooves.

7. A method in accordance with claim 6 in which the edges of the tapered web members are compressed inwardly and the grooves are of an inwardly tapered cross-section.

8. A method in accordance with claim 8 in which the compressed edges of said web members are bonded by adhesive to the inner surfaces of said grooves.

9. A method in accordance with claim 3 in which said second pair of flange members are secured to said pair of tapered web members by the same automatic manufacturing apparatus which formed said I-beam of uniform width except that said apparatus is set for a greater width web and flange assembly than the web member of uniform width.

10. A method in accordance with claim 1 in which the uniform width web member is cut by sawing along a diagonal line to provide two tapered width web members which extend from a maximum width at one end to a minimum width at the other end thereof.

11. A method in accordance with claim 1 in which the first pair of flange members are fastened together by releasable clamping and are unfastened by unclamping.

12. A method of manufacture of tapered wood I-beams, comprising the steps of:

forming an I-beam of substantially uniform width including a wood web member of substantially uniform width secured at its opposite sides to a pair of first flange members;

cutting said uniform width web member diagonally into a pair of tapered width web members which each taper from a maximum width at one end to a minimum width at the other end thereof and is secured to one of said first flange members;

fastening said pair of first flange members together to position the two cut edges of said pair of tapered web members outward of said first flange members and substantially parallel to provide a web and flange assembly of substantially uniform width;

securing a pair of second flange members to the cut edges of said pair of tapered web members; and unfastening said pair of first flange members to disassemble the assembly and provide a pair of tapered I-beams.

13. A method in accordance with claim 12 in which the I-beam of uniform width is formed automatically by a machine and the second flange members are secured automatically to the tapered web members by a machine.

14. A method in accordance with claim 13 in which the forming and securing steps are performed by two separate machines.

15. A method in accordance with claim 13 in which the forming and securing steps are performed by the same machine.

16. A method in accordance with claim 12 in which the tapered web member is formed by a plurality of web portions joined together by joints at their ends so that said web member extends continuously along substantially the entire length of said flange members.

17. A method in accordance with claim 12 in which the uniform width web member is cut by sawing.

18. A method in accordance with claim 12 in which the first flange members are fastened together by clamping and are unfastened by unclamping.

19. A method in accordance with claim 12 in which the web members are made of laminated wood.

20. A method in accordance with claim 12 in which the flange members are made of laminated wood.

* * * * *